US011148257B2

(12) United States Patent
Bradley

(10) Patent No.: US 11,148,257 B2
(45) Date of Patent: Oct. 19, 2021

(54) CLAMPING TOOL

(71) Applicant: WINN & COALES INTERNATIONAL LIMITED, London (GB)

(72) Inventor: Michael S. Bradley, Liberty Hill, TX (US)

(73) Assignee: Winn & Coales International Limited, London (GB)

( * ) Notice: Subject to any disclaimer, the term of this patent is extended or adjusted under 35 U.S.C. 154(b) by 49 days.

(21) Appl. No.: 16/618,750

(22) PCT Filed: May 25, 2018

(86) PCT No.: PCT/GB2018/051439
§ 371 (c)(1),
(2) Date: Dec. 2, 2019

(87) PCT Pub. No.: WO2018/220351
PCT Pub. Date: Dec. 6, 2018

(65) Prior Publication Data

US 2020/0164488 A1 May 28, 2020

Related U.S. Application Data

(60) Provisional application No. 62/552,945, filed on Aug. 31, 2017, provisional application No. 62/514,169, filed on Jun. 2, 2017.

(51) Int. Cl.
*B25B 3/00* (2006.01)
*B25B 5/10* (2006.01)
*B25B 5/16* (2006.01)

(52) U.S. Cl.
CPC ..... *B25B 5/10* (2013.01); *B25B 5/166* (2013.01)

(58) Field of Classification Search
CPC .... B25B 5/00; B25B 5/02; B25B 5/04; B25B 5/067; B25B 5/10; B25B 5/101; B25B 3/00; B23Q 3/00; B23Q 3/06
See application file for complete search history.

(56) References Cited

U.S. PATENT DOCUMENTS 4,114,388 A 9/1978 Straub
6,113,313 A 9/2000 Blair et al.
(Continued)

FOREIGN PATENT DOCUMENTS

DE 9208523 U1 10/1992

OTHER PUBLICATIONS

European Patent Office; International Search Report and Written Opinion issued in corresponding PCT/GB2018/051439, dated Aug. 27, 2018.

*Primary Examiner* — Lee D Wilson
(74) *Attorney, Agent, or Firm* — Dykema Gossett PLLC

(57) ABSTRACT

A clamping tool (1) is disclosed suitable for securing underwater protective shields, jackets and covers. A system is also described comprising the clamping tool and a protective shield, jacket or cover. The clamping tool (1) comprises a clamp (2), a jaw attachment (12) and a plurality of locking bolts (46). The clamp (2) comprises a first claw (20), a second claw (22), and a pivot (3). The jaw attachment (12) comprises a first tube (40) connected to the first claw (20) and a second tube (42) connected to the second claw (22). The first tube (40) and the second tube (42) comprise a plurality of holes (44) for receiving the plurality of locking bolts (46) and the pivot (3) is configured to transform a rotational torque applied by a user into a clamping pressure of the jaw attachment (12).

21 Claims, 10 Drawing Sheets

(56) References Cited

U.S. PATENT DOCUMENTS

| | | | |
|---|---|---|---|
| 10,307,893 | B2 | 6/2019 | Costen |
| 2010/0154987 | A1 | 6/2010 | Vontell |

CLAMPING TOOL

FIELD OF THE INVENTION

The present invention relates generally to a clamping tool. In some embodiments the clamping tool enables a user to secure an underwater protective shield or cover, while the installation operations are conducted.

BACKGROUND OF THE INVENTION

People often look for better tools to accomplish various tasks. Construction for example, requires the use of numerous tools that are designed to help a user complete a task effortlessly and more efficiently. As an example, infrastructure requires the use of heavy duty equipment and an extensive workforce to complete difficult projects. In order to hold piers, docks, buildings, and other large structures over and within bodies of water, a variety of support structures are used. Such supports, particularly structural beams, are generally made of concrete or steel, but can also be made of other rigid materials. The building material must be rigid and strong to ensure that the structure above remains well-supported, even under potentially heavy cyclical loads such as traffic and people.

This results in the prioritization of building materials for their mechanical strength, oftentimes at the cost of electrochemical inertness. Inert materials are desirable in constructing underwater systems, particularly in large, untreated bodies of water such as lakes or oceans, because such materials ensure that the supports do not degrade over time. In response, a variety of covers and protective barriers have been developed. Many of these barriers utilize a sheet of plastic joined at its edges by plastic external welding. Such a solution is undesirable because these plastic covers can often fail over time due to the mechanical weakness of the external weld. The external weld remains a weak spot when currents, floating debris, mechanical impact or otherwise moving waters apply pressure to the system. What is needed is a device that protects the mechanically weak segments of such a system. Further desirable is a system that can protect marine supports from various underwater stimuli without relying solely on wax coatings that can be removed by impacts often encountered in aggressive marine environments.

Conducting work in a marine environment is especially difficult, due to the hazardous conditions. The present invention aims to facilitate the installation process of a pillar protection cover by disclosing a clamping tool designed to temporarily secure the protective cover before the final assembly is completed. The user is able to retain the full use of their hands, while installing the protective cover. Having full range of motion is especially important in hazardous working conditions.

BRIEF SUMMARY OF THE INVENTION

In one embodiment there is provided a clamping tool for securing an underwater protective shield or cover, the clamping tool comprising a clamp, a jaw attachment and a plurality of locking bolts;

the clamp comprising a first claw, a second claw, and a pivot;

the jaw attachment comprising a first tube connected to the first claw and a second tube connected to the second claw;

wherein the first tube and the second tube comprise a plurality of holes for receiving the plurality of locking bolts;

the pivot being configured to transform a rotational torque applied by a user into a clamping pressure of the jaw attachment.

The first tube and the second tube may extend transversely with respect to the first claw and the second claw; a longitudinal length of each of the first tube and the second tube being sufficient such that the first tube and the second tube may extend beyond each side of the first claw.

The clamp may be located at a mid-point of a longitudinal length of the jaw attachment.

The first claw may comprise two parallel plate members interconnected by a plurality of pins.

The second claw may comprise two parallel plate members interconnected by a plurality of pins.

The first claw and second claw may be connected together via a centrally positioned fixed pin.

The plurality of holes may be aligned on the first tube and the second tube. The plurality of holes may comprises a first plurality of holes aligned on the first tube and the second tube to one side of the clamp and a second plurality of holes aligned on the first tube and the second tube to an opposed side of the clamp; the first plurality of holes receiving a first locking bolt and the second plurality of holes receiving a second locking bolt.

The pivot may comprise a threaded rod and optionally a ratchet attachment.

The first claw may resembles an L-shape bracket, and optionally comprise a widened centre support.

The jaw attachment may be integrated into the clamp.

The first tube may be welded to the first claw and the second tube may be welded to the second claw. Alternatively, the first tube may be detachable from the first claw and the second tube may be detachable from the second claw.

In one example the first tube and the second tube are square tubing.

In some embodiments the clamping tool may comprise more than one clamp attached to the jaw attachment.

In another embodiment there is provided a clamping tool for securing a protective cover, the clamping tool comprising a clamp, a jaw attachment and a plurality of locking bolts;

the clamp comprising a first claw, a second claw, and a pivot having a threaded rod;

the jaw attachment comprising a first tube connected to the first claw and a second tube connected to the second claw;

the first tube and the second tube extending transversely to the clamp;

the clamp being attached to the first tube at a central point of a longitudinal length of the first tube and the clamp being attached to the second tube at a central point of a longitudinal length of the second tube;

the first tube extending beyond outer faces of the first claw;

the second tube extending beyond outer faces of the second claw;

the first tube and the second tube comprising a plurality of holes including at least a first plurality of holes aligned on the first tube and the second tube and located to one side of the clamp and a second plurality of holes aligned on the first tube and the second tube and located to another side of the clamp such that the clamp is located between the first plurality of holes and the second plurality of holes;

the first plurality of holes receiving a first locking bolt and the second plurality of holes receiving a second locking bolt;

wherein the pivot is configured to transform a rotational torque applied by a user into a clamping pressure of the jaw attachment.

In another embodiment there is provided a clamping system comprising a clamping tool as described in any of the embodiments above and a power tool, wherein the pivot of the clamping tool comprises a threaded rod and a ratchet attachment and the power tool comprises a socket for driving engagement with the ratchet attachment.

In another embodiment there is provided a method of securing a protective cover comprising the step of temporarily securing the protective cover using a clamping tool before a final assembly of the protective cover is completed;

wherein the protective cover comprises a lip having a plurality of holes;

wherein the clamping tool comprises a jaw attachment having a first tube connected to a first claw and a second tube connected to a second claw;

the first tube having a plurality of holes and the second tube having plurality of holes, the first claw and the second claw being movable by rotational torque applied to a threaded rod to induce a clamping pressure of the jaw attachment;

wherein temporarily securing the protective cover comprises aligning the plurality of holes of the lip of the protective cover with the plurality of holes of the first tube and the plurality of holes of the second tube;

subsequently inserting a plurality of locking bolts through the plurality of holes of the lip of the protective cover and the plurality of holes of the first tube and the plurality of holes of the second tube;

rotating the threaded rod to decrease the distance between the first tube and the second tube to apply a uniform clamping pressure onto the lip of the protective cover.

After temporarily securing the protective cover using the clamping tool, the protective cover may be finally assembled, wherein said final assembly may comprise inserting and securing a plurality of screws or bolts through the lip of the protective cover and subsequently removing the clamping tool.

In some embodiments, temporarily securing the protective cover takes place underwater.

Examples of the present invention will now be described, by way of example only, with reference to the accompanying drawings, in which:

DETAIL DESCRIPTION OF THE INVENTION

All illustrations of the drawings are for the purpose of describing selected versions of the present invention and are not intended to limit the scope of the present invention.

Having the correct tools for the job, allows a worker to complete the task effortlessly and more efficiently. The safety of the worker is a priority in hazardous working conditions, therefore dedicated tools are designed to not only prevent physical injuries, but also make completing the task at hand quicker and more efficient. Due to the harsh and corrosive environment where support pillars are typically placed, protective covers are often times installed to increase the longevity of the construction.

Figure 1:
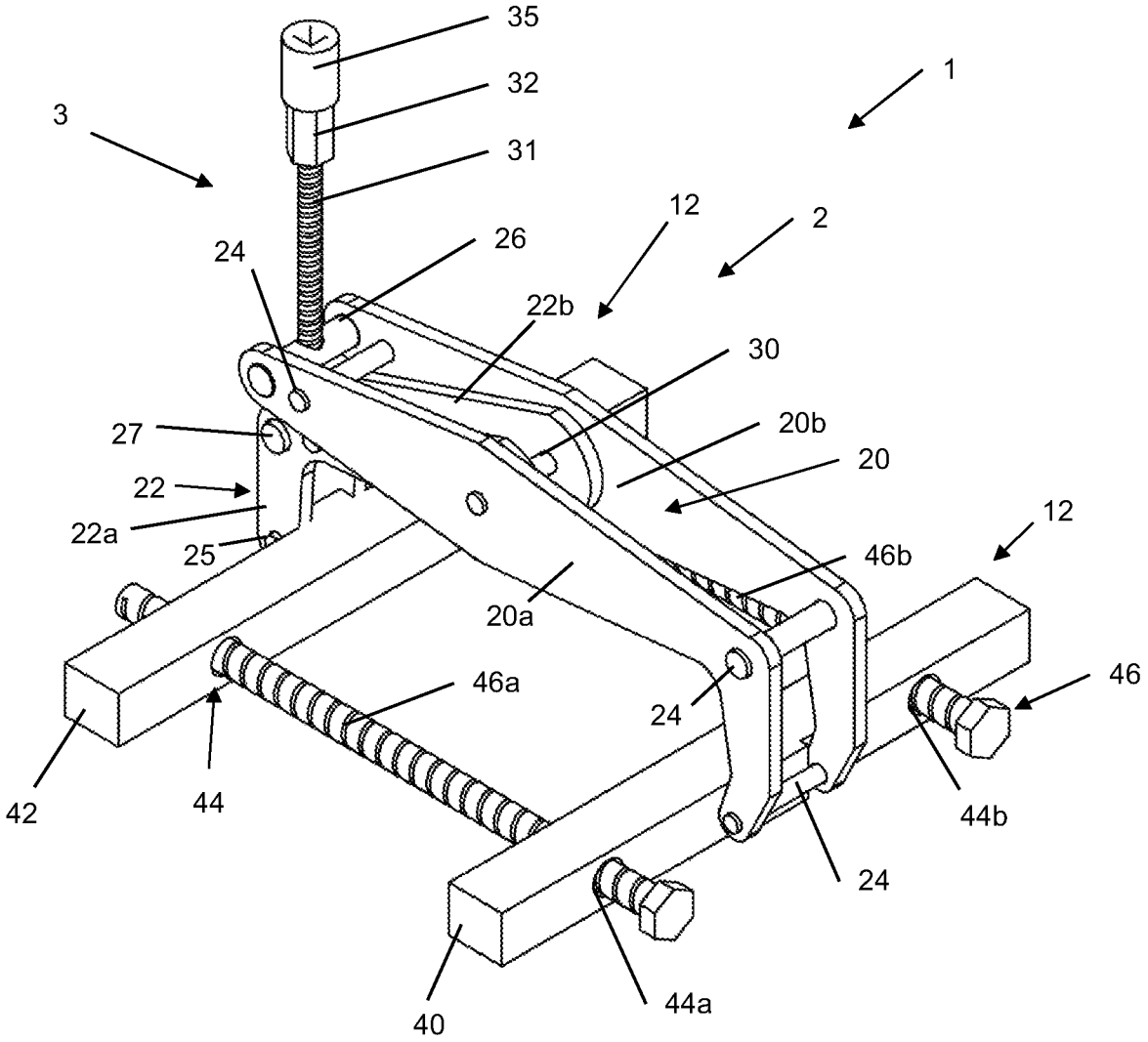
FIG. 1 is a perspective view of a clamping tool according to the present invention.
Figure 2:
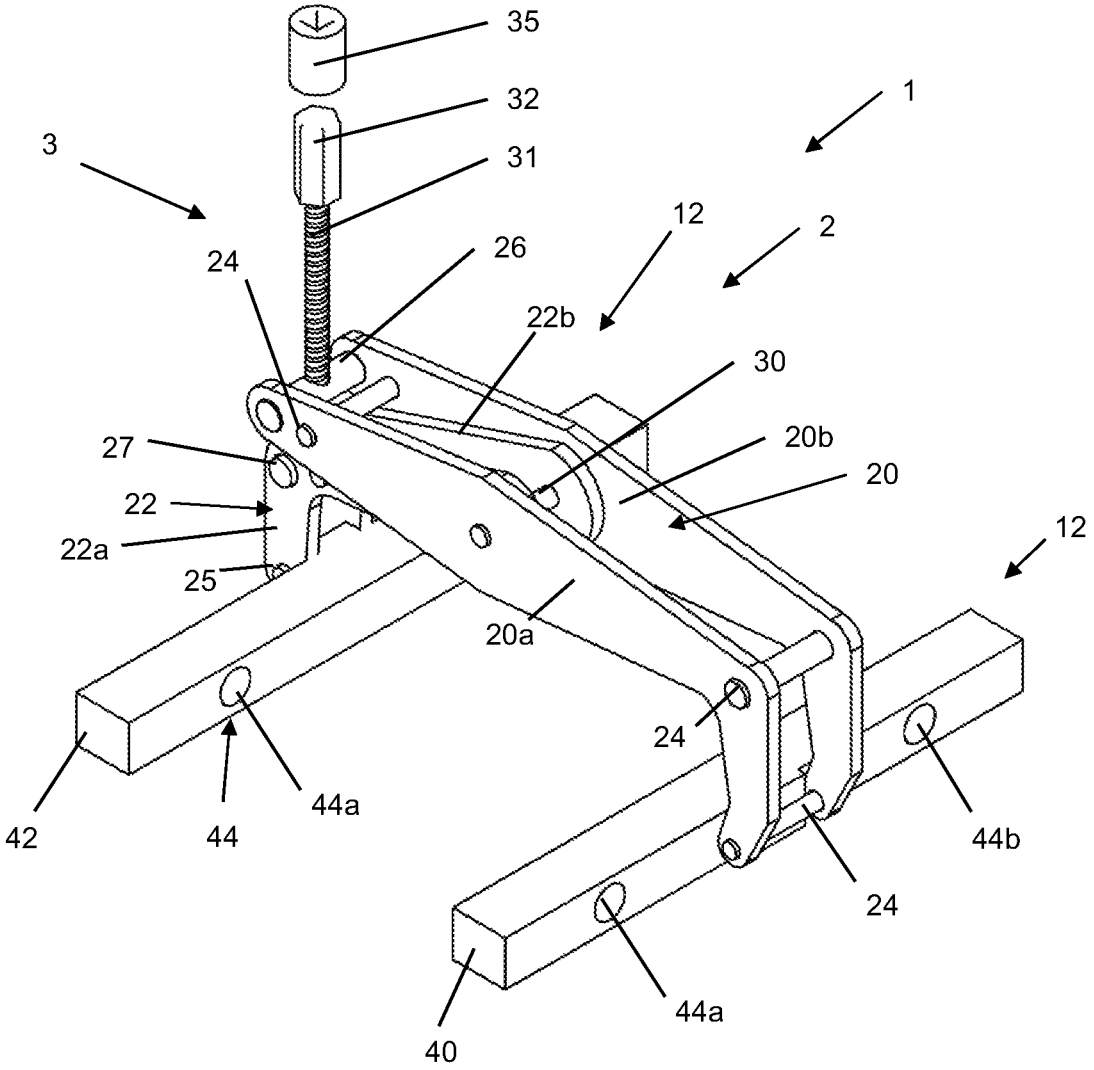
FIG. 2 is a perspective view of the clamping tool of FIG. 1, with the locking bolts removed.

In reference to FIGS. 1 and 2, an example of a clamping tool 1 of the present invention comprises a clamp 2, a jaw attachment 12 and a plurality of locking bolts 46 (also referred to as locking screws).

The clamping tool 1 may be used to secure various objects, in numerous applications. In the current example, the clamping tool 1 used in the present invention resembles a single screw pivotal clamp, more commonly known as a Kant clamp. One of the advantages of the Kant clamp is the ability to prevent interference with the clamped objects. Furthermore, this type of clamp is capable of exerting and maintaining a consistently high level of applied force. While in this application the present invention integrates the use of a Kant clamp, many other types of clamps with an integrated threaded rod, and a supported pin handle, may be added to the design.

In reference to FIG. 2, the clamp 2 of the present invention comprises a first claw 20, a second claw 22, a plurality of pins 24, 25, and a pivot 3.

Figure 3:
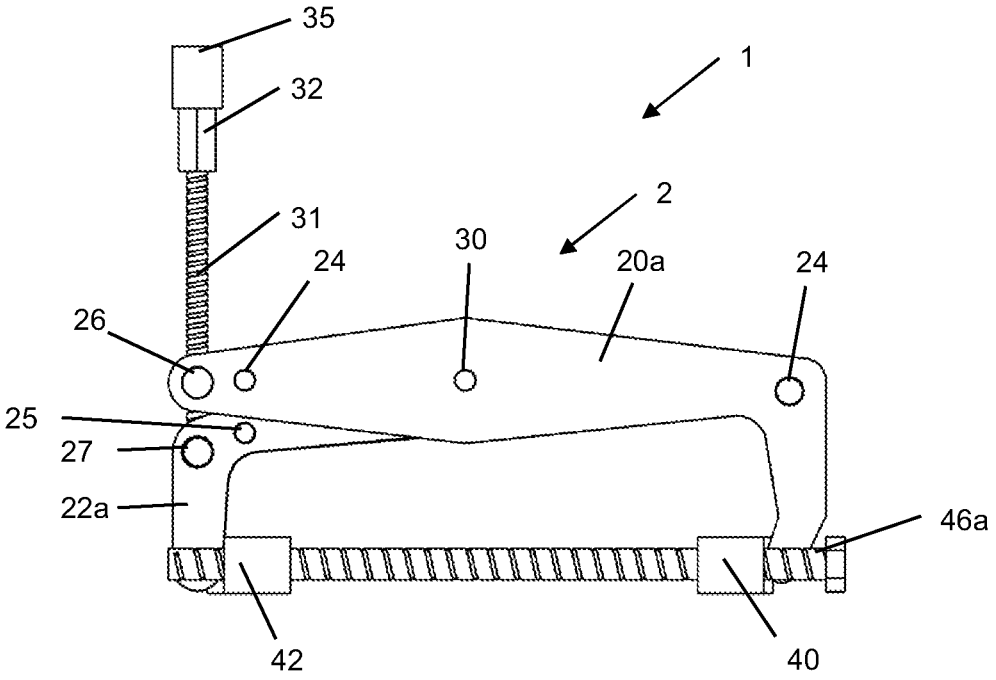
FIG. 3 is a front view of the clamping tool of FIG. 1.
Figure 4:
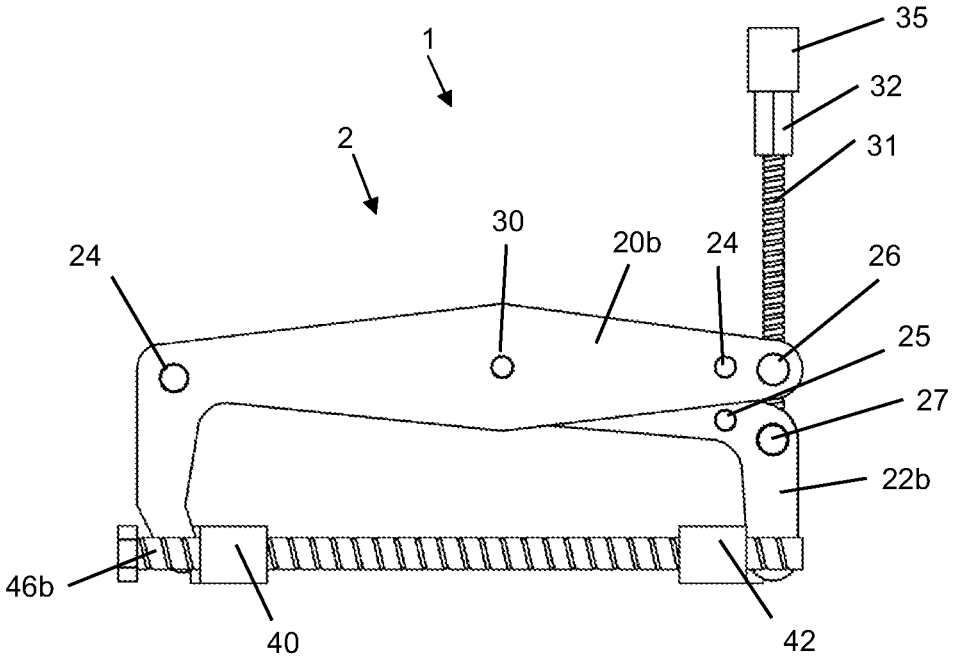
FIG. 4 is a back view of the clamping tool of FIG. 1.

The first claw 20 resembles an L-shape bracket, with a widened center support for increased strength, as seen in FIG. 3. The first claw 20 comprises a first plate member 20*a* and a second plate member 20*b* of the same shape and size as each other. The first claw 20 further comprises a plurality of circular slots in each of the first plate member 20*a* and the second plate member 20*b*, into which the plurality of pins 24 is press fit to interconnect the first plate member 20*a* and the second plate member 20*b*. Once interconnected the first plate member 20*a* and the second plate member 20*b* are parallel to one another as shown in FIGS. 5 and 6.

The second claw 22 comprises a first plate member 22*a* and a second plate member 22*b* of the same shape and size as each other. The second claw 22 further comprises a plurality of circular slots in each of the first plate member 22*a* and the second plate member 22*b*, into which the plurality of pins 25 is press fit to interconnect the first plate member 22*a* and the second plate member 22*b*. Once interconnected the first plate member 22*a* and the second plate member 22*b* are parallel to one another as shown in FIGS. 5 and 6.

An internal width of the first claw 20, between interior faces of the first plate member 20*a* and the second plate member 20*b* is marginally wider than an external width of the second claw 22—measured between exterior faces of the first plate member 22*a* and the second plate member 22*b*.

Figure 5:
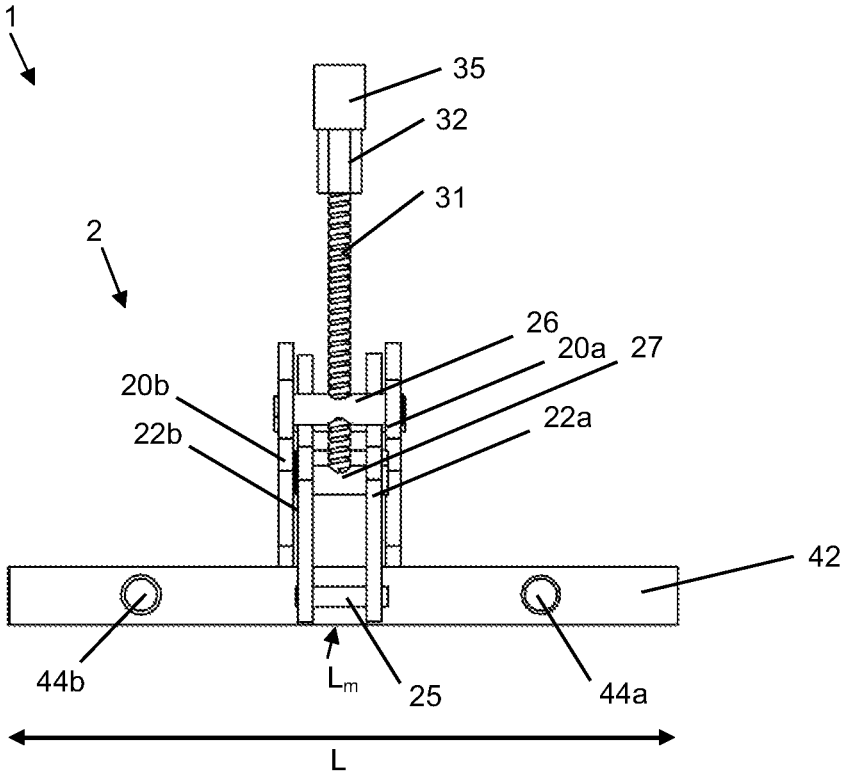
FIG. 5 is a left view of the clamping tool of FIG. 1.
Figure 6:
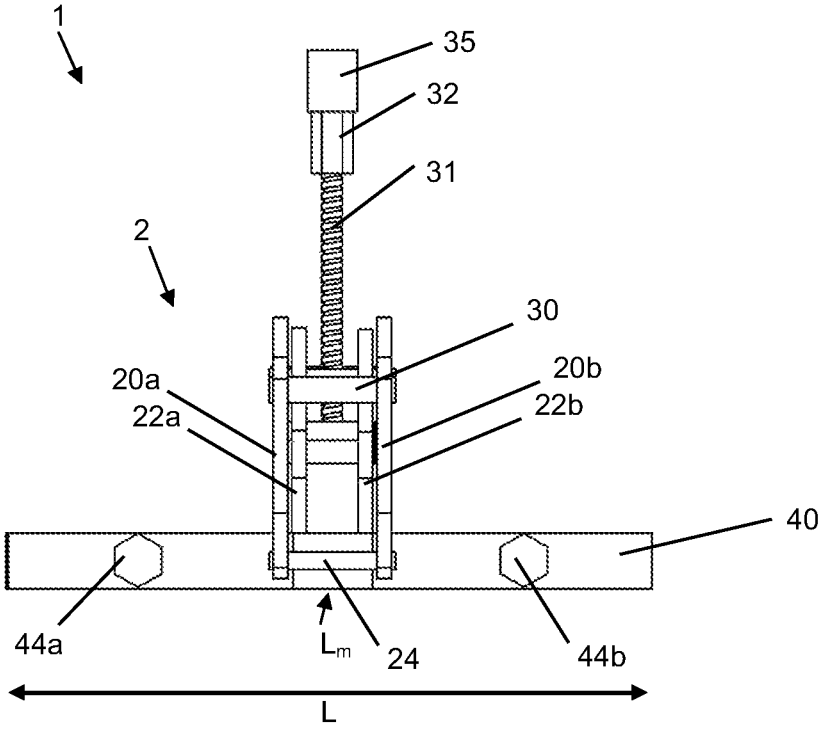
FIG. 6 is a right view of the clamping tool of FIG. 1.

Thus, the second claw 22 can be located at least partially within the first claw 20 as shown in FIGS. 1 and 5.

The first claw 20 and the second claw 22, are connected via a centrally positioned fixed pin 30, which is connected at the widened end of the second claw 22. The centrally positioned fixed pin 30 allows the first claw 20 and the second claw 22 to rotate relative to one another.

The pivot 3 comprises a threaded rod 31 that extends generally perpendicularly to the jaw attachment 12. A lower end of the threaded rod 31 is connected to a pivot end pin 27 that extends between the first plate member 22*a* and the second plate member 22*b* of the second claw 22 as shown in FIG. 5. The threaded rod 31 passes through a threaded pin 26 that extends between the first plate member 20*a* and the second plate member 20*b* of the first claw 20, as shown in FIG. 5. The pivot 3 further comprises a hexagonal-shaped end 32 at a distal end of the threaded rod 31 that can receive a ratchet attachment 35 as seen in FIGS. 5 and 6.

In reference to FIG. 5, the pivot 3 allows the user to separate the first claw 20 and the second claw 22, at various distances to easily engage the object being secured. Rotation of the threaded rod 31 changes the relative distance between the pivot end pin 27 and the threaded pin 26 since the pivot end pin 27 is longitudinally fixed relative to the threaded rod 31 while the threaded pin 26 is able to move along the threaded rod 31 due to mating engagement of an external thread on the threaded rod 31 and an internal thread on the threaded pin 26. Therefore, rotation of the threaded rod 31 causes the first claw 20 and the second claw 22 to rotate relative to one another.

The present invention transforms the rotational torque applied by the user into a consistent clamping pressure. In large scale applications, applying the torque manually to the threaded rod 31 is not a feasible option, due to the force required, and the challenging working environment. The present invention aims to solve that problem by disclosing the ratchet attachment 35. The ratchet attachment 35 is positioned onto the hexagonal-shaped end 32 of the threaded rod 31, allowing the user to use a plurality of sockets. By integrating a standardized socket at the end of the threaded rod 31, manual or power tools may be used to apply the required torque, thus decreasing the effort needed to separate the first claw 20 and the second claw 22.

Figure 7:
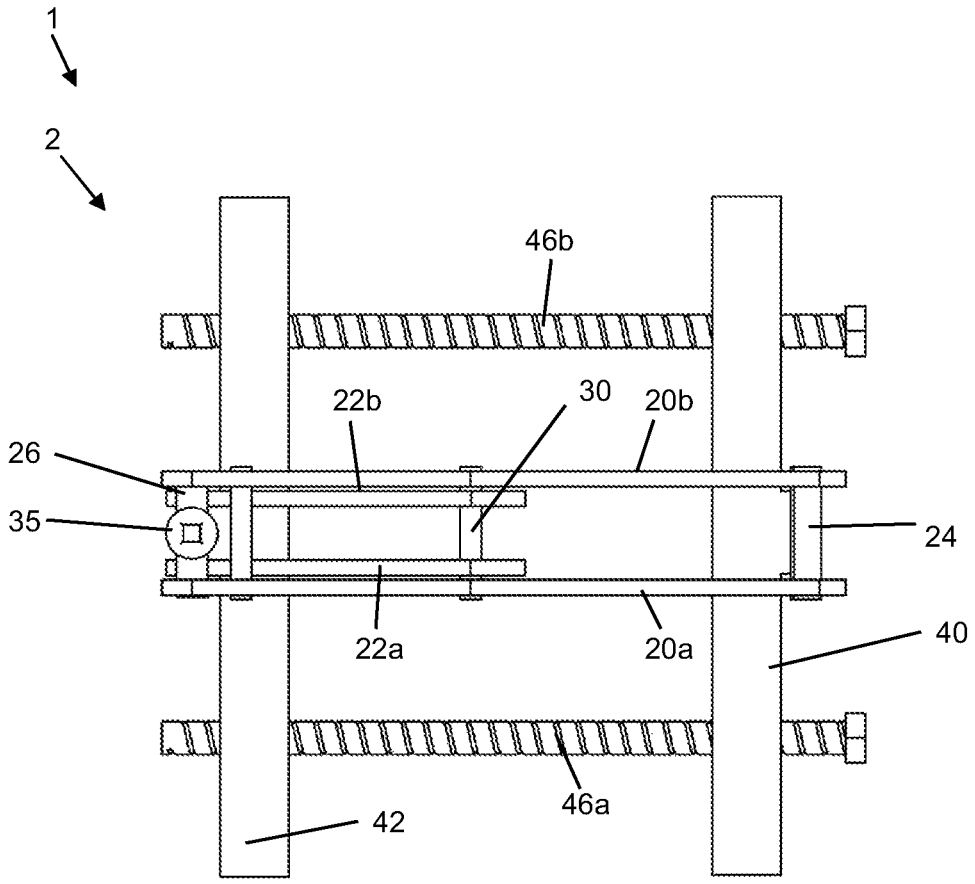
FIG. 7 is a top view of the clamping tool of FIG. 1.

The jaw attachment 12 of the present invention comprises a first tube 40, a second tube 42 and a plurality of holes 44 that receive the plurality of locking bolts 46 as shown in FIG. 1 and FIG. 7. In the current example, the plurality of tubes 40, 42 is manufactured out of square tubing. However the present invention is not limited to this option.

The first tube 40 and the second tube 42 may be of the same length L as shown in FIGS. 5 and 6. The first tube 40 and the second tube 42 extend transversely with respect to the first claw 20 and the second claw 22. Preferably, the first tube 40 and the second tube 42 are perpendicular to the first claw 20 and the second claw 22.

The length L of the first tube 40 and the second tube 42 is sufficient such that the first tube 40 and the second tube 42 extend beyond each side of the first claw 20, i.e. length L is greater than the distance between the exterior faces of the first plate member 20*a* and the second plate member 20*b*, as shown in FIG. 5. The length L is sufficient such that the plurality of holes 44 are located to either side of the first claw 20 when viewed in the orientation of FIG. 5.

Preferably, the first claw 20 and the second claw 22 are centrally located on the first tube 40 and the second tube 42 as shown in FIG. 5 such that a mid-point, $L_m$, of the longitudinal length of the jaw attachment 12 is aligned with the mid-point between the first plate member 20*a* and the second plate member 20*b*.

Preferably, the length L is 4 to 6 times the distance between the exterior faces of the first plate member 20*a* and the second plate member 20*b*. More preferably, the length L is about 5.5 times the distance between the exterior faces of the first plate member 20*a* and the second plate member 20*b* as shown in FIG. 5.

The jaw attachment 12 is integrated into the clamp 2. Various permanent attachments methods may be used to connect the jaw attachment 12 to the clamp 2 including but not limited to welding. In another example, the jaw attachment 12 of the present invention may be detachable from the clamp 2.

The plurality of holes 44 is designed to keep the locking bolts 46 in alignment. The plurality of holes 44 is aligned on the first tube 40 and the second tube 42. In the orientation of the clamping tool 1 as shown in FIG. 1, the plurality of holes 44 comprises a first plurality of holes 44*a* aligned on the first tube 40 and the second tube 42 to one side of the clamp 2 (to the left as viewed in FIG. 1) and a second plurality of holes 44*b* aligned on the first tube 40 and the second tube 42 to the other side of the clamp 2 (to the right as viewed in FIG. 1).

A first locking bolt 46*a* is receivable in the first plurality of holes 44*a*. A second locking bolt 46*b* is receivable in the second plurality of holes 44*b*.

Figure 15:
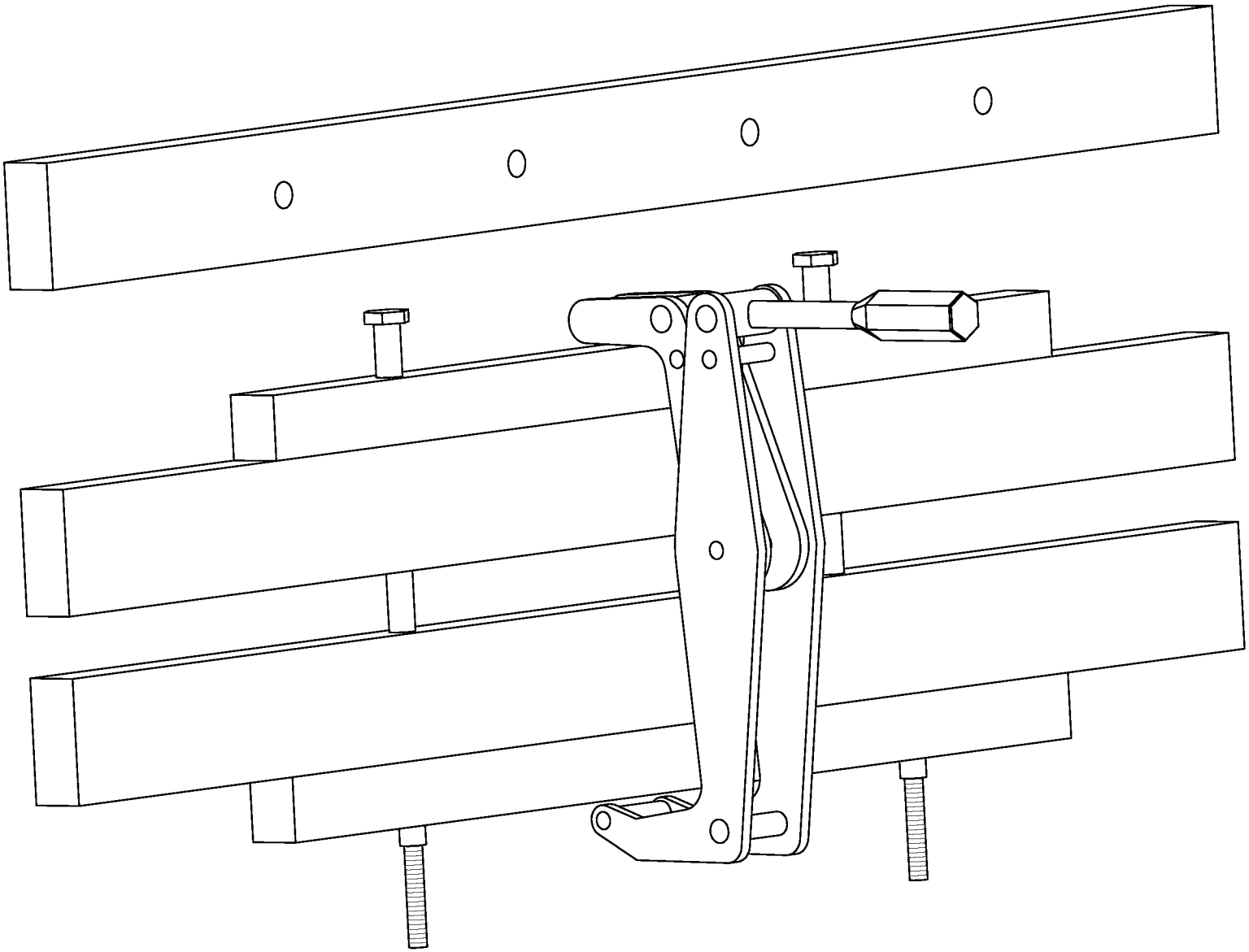
FIG. 15 is a picture of the clamping tool of the present invention clamped to a protective cover.

The jaw attachment 12 is designed to apply a uniform clamping pressure onto the lip of a protective cover 100 as shown in FIG. 15 and will be described in greater detail below. As the first tube 40 and the second tube 42 are brought closer together the user aligns the plurality of holes 44 concentrically with a plurality of holes in the protective cover 100. After the alignment is complete, and the clamping tool 1 secured the user still maintains full range of motion of their hands, thus inserting a plurality of locking bolts 160 is an easy task.

A plurality of materials may be used to manufacture the present invention. In the current example, the present invention is manufactured out of zinc plated steel to prevent corrosion. The body of the present invention may further be treated with an anticorrosive gel. In another example, more than one clamp 2 may be attached to the jaw attachment 12. This set-up would be especially useful for large scale applications.

FIGS. 8 to 14 illustrate an example of a protective cover 100 that is suitable to be clamped by the clamping tool 1 of the present invention. Thus, the clamping tool 1 and protective cover 100 may comprises at least part of a clamping system which may further comprise a power tool, wherein the pivot 3 of the clamping tool 1 may be driven by action of the power tool.

The protective cover 100 enables a user to protect the corrosion control layer installed on underwater beams, e.g. piles, that support large structures, such as piers, boardwalks, and buildings from the external marine environment. Such supports are typically coated with any of a variety of protective films, tapes, hydrophobic sprays, or combinations of the above that reduce environmental degradation effects on the support. By wrapping the protective cover 100 around the supports, the present invention prevents water damage due to exposure of the supports and coatings to heavy, moving, and otherwise damaging water.

Figure 8:
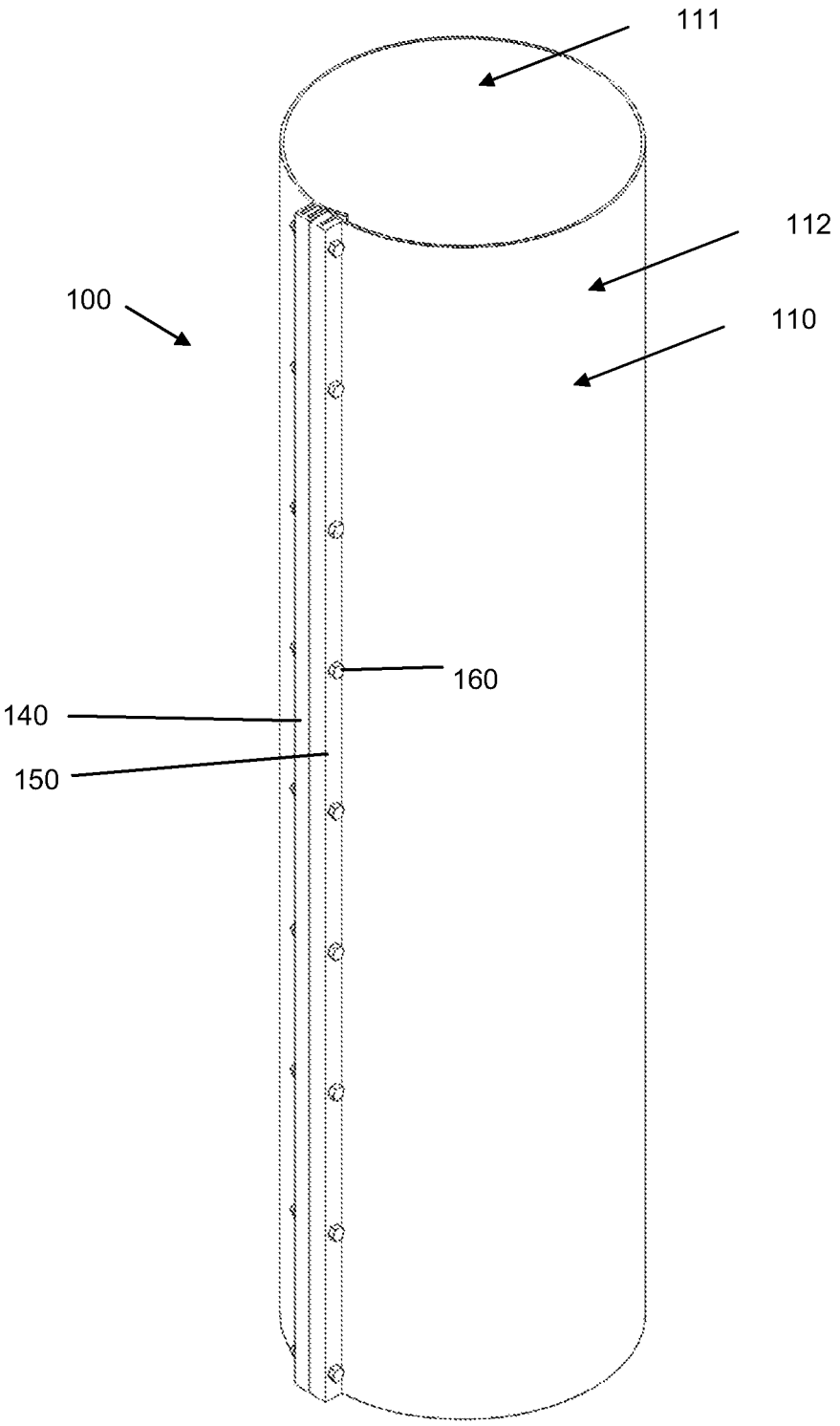
FIG. 8 is a front corner perspective view of a protective cover suitable to be clamped by the clamping tool of FIG. 1.
Figure 9:
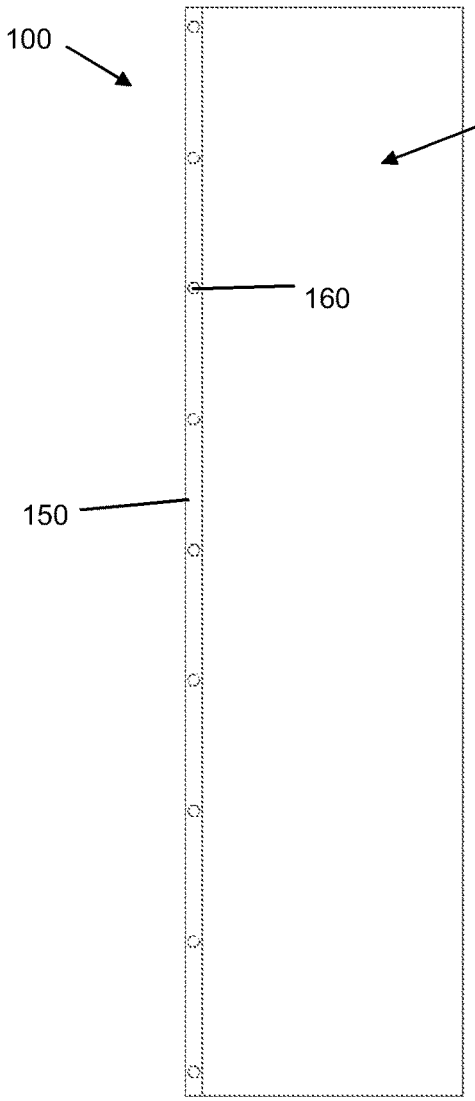
FIG. 9 is a front view of the protective cover of FIG. 8.

The protective cover 100 as shown in FIGS. 8 and 9 comprises a body 110, a first support 140, a second support 150, and a plurality of bolts (also referred to as screws) 160.

Figure 11:
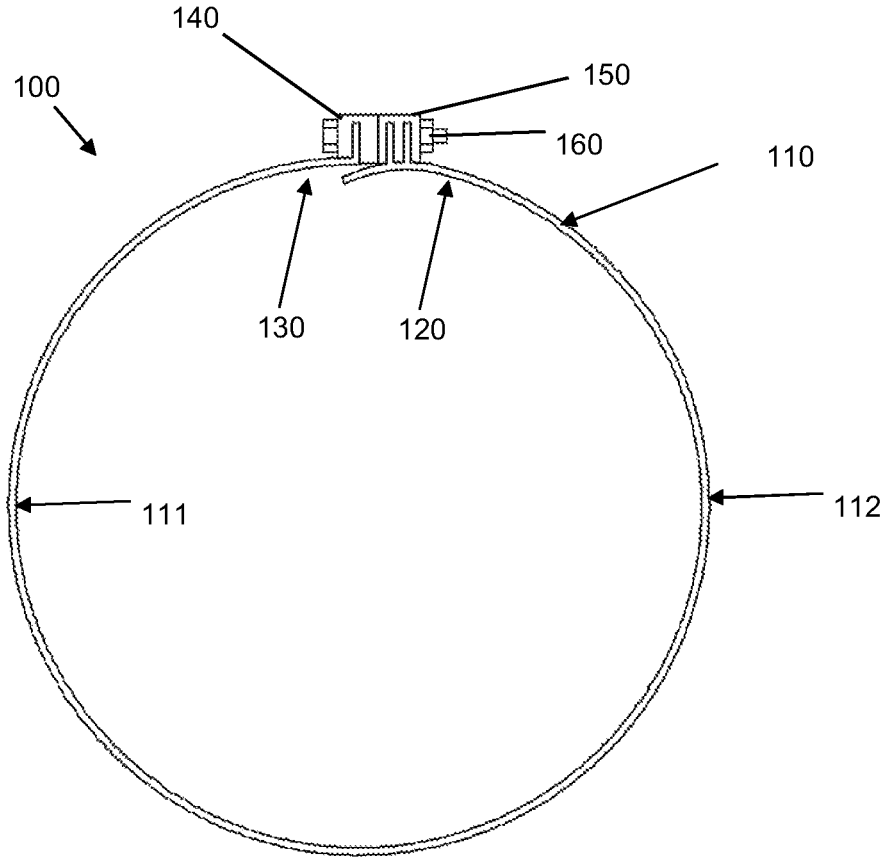
FIG. 11 is a top view of the protective cover of FIG. 8.
Figure 12:
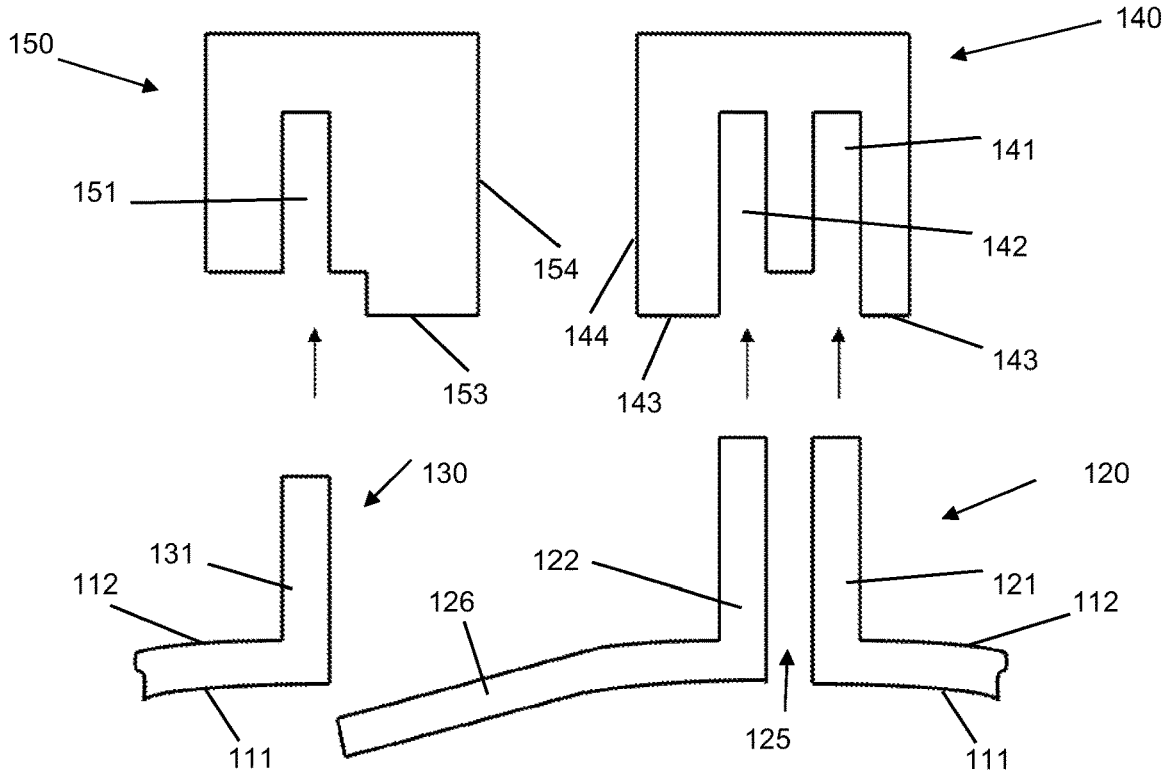
FIGS. 12 to 14 are schematic top views of a portion of the protective cover of FIG. 8 illustrating manufacturing steps of the protective cover.

The body 110 is the main coverage unit that, in the preferred usage of the present invention, wraps around an underwater support. The body 110 comprises a first end 120, a second end 130, a first surface 111, and a second surface 112, as seen in FIGS. 11 and 12. The first end 120 is a segment of the present invention that enables connection to the first support 140, and secures the first end 120 to the first support 140.

As shown in FIG. 12 the first end 120 comprises a first extrusion 121, a weld 123, a second extrusion 122, and a plurality of screw holes. The first extrusion 121 is a pre-bent segment of material that extends perpendicularly to the body 110 and runs the length of the first end 120 that enables attachment of the first end 120 to the first support 140. The weld 123 is a connection that joins the first extrusion 121 and the second extrusion 122 together. The second extrusion 122 is a pre-bent segment of material that extends perpendicularly to the body 110 and runs the length of the first end 120 that enables attachment of the first end 120 to the first support 140.

The plurality of screw holes is a linear pattern of circular cuts through the first end 120 that enables attachment of the plurality of screws. The plurality of screw holes is cut through both the first extrusion 121 and the second extrusion 122.

The second end 130 is a segment of the present invention that enables connection to the second support 150, and secures the second end 130 to the second support 150. The second end 130 comprises an extrusion 131, a weld 133, and a plurality of screw holes. The extrusion 131 is an elongated segment of material running the length of the body 110 that enables attachment of the second end 130 to the second support 150. The weld 133 is a connection that joins the extrusion 131 permanently to the second support 150. The plurality of screw holes is a linear pattern of circular cuts through the second end 130, and in particular through the extrusion 131, that enables attachment of the plurality of screws 160.

The first surface 111 of the body 110 contacts the outside of a support, in the preferred usage of the present invention. The second surface 112, in the preferred usage of the present invention, faces generally away from the support.

Figure 13:
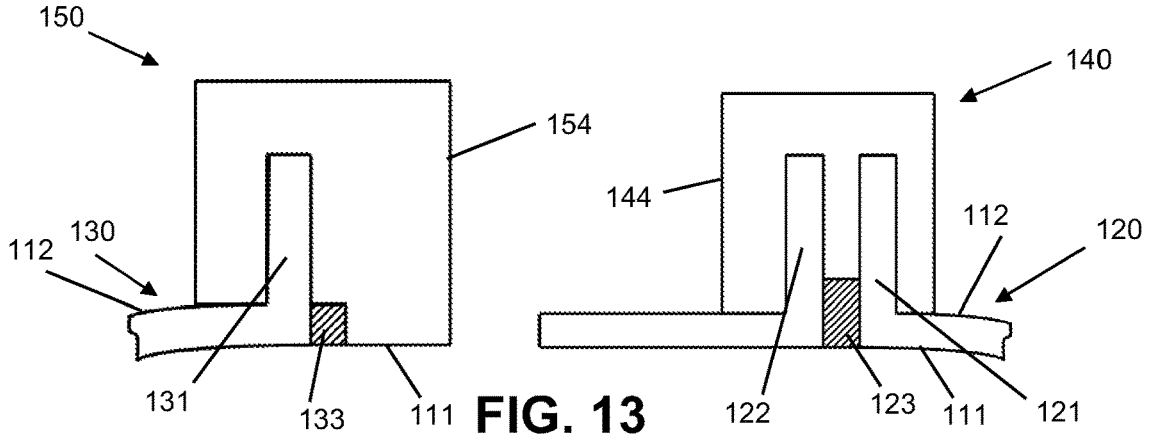

As shown in FIG. 12 the first support 140 is an extruded segment that enables connection of the first end 120 of the body 110. The first support 140 comprises a first channel 141, a second channel 142, and a plurality of surfaces. The first channel 141 is an extended cut through the first support 140 that extends through the length of the body, enabling the first extrusion 121 of the first end 120 of the body 110 to secure within the first support 140 by means of a friction fit. The second channel 142 is an extended cut through the first support 140 that extends through the length of the body, enabling the second extrusion 122 of the first end 120 of the body 110 to secure within the first support 140 by means of a friction fit as shown in FIG. 13. The plurality of surfaces is a set of flat sides that enable the user to place the first support 140 proximally to the second support 150. The plurality of surfaces comprises a first surface 143 and a second surface 144. The first surface 143 is the side that connects to the second surface 112 of the body 110 of the present invention. The second surface 144 is a surface that is arranged flush with the second support 150 in the preferred usage of the present invention as shown in FIG. 14.

As shown in FIG. 12 the second support 150 is an extruded segment that enables connection of the second end 130 of the body 110. The second support 150 comprises a channel 151 and a plurality of surfaces. The channel 151 is an extended cut through the second support 150 that extends through the length of the body, enabling the extrusion 131 of the second end 130 of the body 110 to secure within the second support 150 by means of a friction fit as shown in FIG. 13. The plurality of surfaces is a set of flat sides that enable the user to place the second support 150 proximally to the first support 140. The plurality of surfaces comprises a first surface 153 and a second surface 154. The first surface 153 is the side that connects to the second surface 112 of the body 110 of the present invention. The second surface 154 is a surface that is arranged flush with the first support 140 in the preferred usage of the present invention as shown in FIG. 14.

Figure 10:
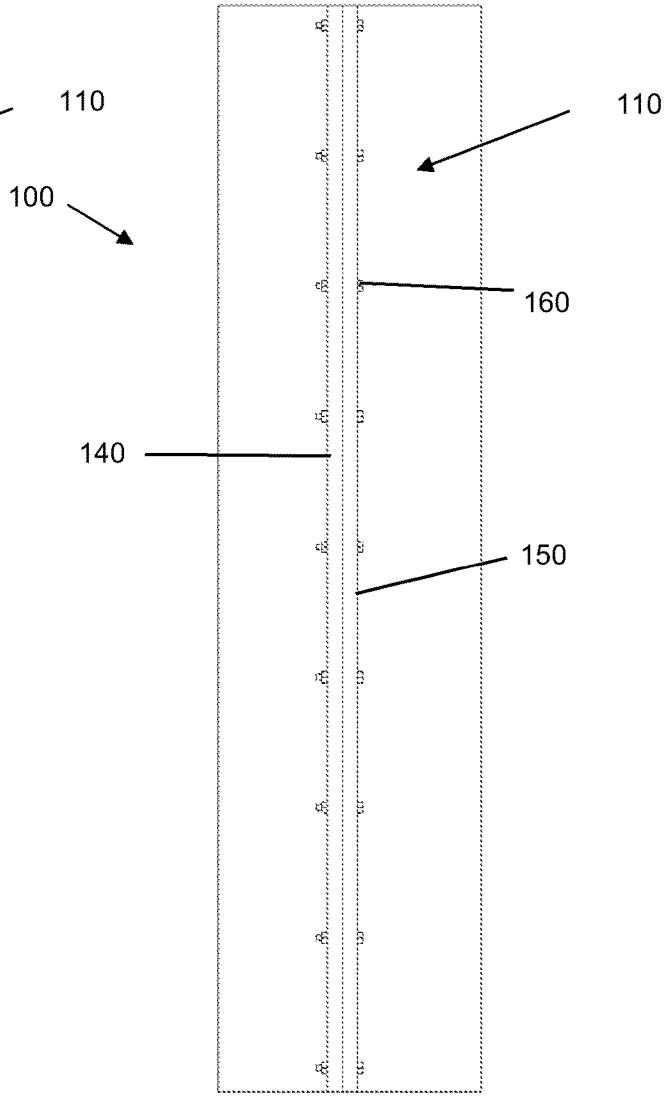
FIG. 10 is a left view of the protective cover of FIG. 8.
Figure 14:
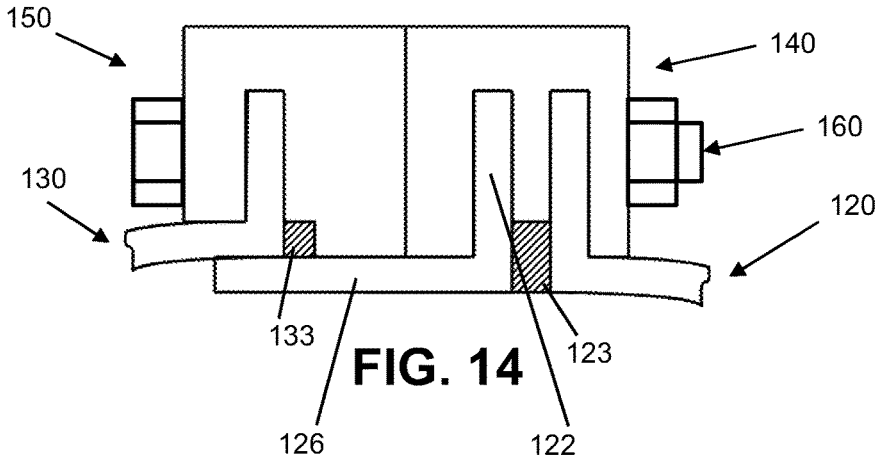

The plurality of screws 160 is a set of connectors that secures the first support 140 to the second support 150 as shown in FIG. 14. The plurality of screws 160 fits through the plurality of screw holes of the first end 120 of the body 110 and the plurality of screw holes of the second end 130 of the body 110, as seen in FIG. 10. The plurality of screws 160 comprises a plurality of bolts and nuts. The plurality of nuts secures to the exposed end of the plurality of screws/bolts to lock the plurality of screws/bolts in place within the first end 120 and the second end 130 of the body 110.

In the preferred manufacturing of the present invention, the user acquires the protective cover 100. The user bends the first extrusion 121 of the first end 120, the second extrusion 122 of the first end 120, and the extrusion 131 of the second end 130. The user then places the first extrusion 121 of the first end 120 and the second extrusion 122 of the first end 120 into the first channel 141 and the second channel 142 of the first support 140, respectively. The user then welds along the gap 125 between the first extrusion 121 and the second extrusion 122. This weld 123 is protected from being a point of mechanical weakness by the first support 140 as shown in FIG. 13.

The user then places the extrusion 131 of the second end 130 into the channel 151 of the second support 150, under the overlapping segment 126 of the first end 120 of the body 110. The user then welds the extrusion 131 of the second end 130 in place within the second support 150. This weld 133 is protected from being a point of mechanical weakness by the second support 150 as shown in FIG. 13.

The user then places the plurality of screws 160 through the plurality of screw holes of the first end 120 and the plurality of screw holes of the second end 130, thus securing the first support 140 and the second support 150 together, and subsequently secures the plurality of screws 160 in place using the plurality of nuts. The present invention is now fully assembled.

The protective cover 100 may be provided to the user in this assembled state.

In the preferred usage of the present invention, the user acquires the protective cover 100, which may as noted above be in an assembled state in which case the user will first unfasten and remove the plurality of screws 160 from the plurality of screw holes. The user then wraps the first surface 111 around an underwater support, so that the first support 140 and the second support 150 face generally away from the underwater support.

The user subsequently places the plurality of screws 160 through the first support 140, the first end 120, the second end 130, and the second support 150. In order to carry out this step, the user may use the clamping tool 1 described above and shown in FIGS. 1 to 7 to clamp the first support 140 to the second support 150 to engage and hold in position the second surface 144 and the second surface 154 of the respective first support 140 and second support 150. As described above, during application of the clamping tool 1 to the protective cover 100 the plurality of locking bolts 46 of the clamping tool 1 may be inserted through the plurality of holes 44 of the clamping tool 1 and at the same time through the plurality of screw holes of the first end 120 and the second end 130 to ensure that the first support 140 and the second support 150 remain aligned longitudinally during clamping.

Next, the user places the plurality of nuts over the exposed ends of the plurality of screws 160 and tightens them to secure them in place. The second extrusion 122 overlaps the second end 130 of the body as shown in FIGS. 11 and 14, thus further ensuring optimal protection of the support and coating within the present invention.

This arrangement ensures a watertight closure that enables no liquid to pass through, and further ensures that no liquid can contact and subsequently degrade the welded joint that often causes failure in existing support guards.

FIG. 15. illustrates one example of a protective cover 100 being clamped by a clamping tool 1.

In order to remove the protective cover 100, the user unscrews the plurality of nuts from the plurality of screws 160, removes the plurality of screws 160, and removes the body 110 from the support being protected. The present invention is prepared for subsequent application.

Although the invention has been explained in relation to its preferred embodiment, it is to be understood that many other possible modifications and variations can be made without departing from the spirit and scope of the invention.

It will be understood by the person skilled in the art that modifications may be made to the embodiments shown and described above by way of example without departing from the present invention. The present invention is not limited to the embodiments shown and described, but it is intended to cover all modifications within the scope of the present invention, as defined by the claims.

Those of ordinary skill in the art will understand that the figures and descriptions of the invention may have been simplified to facilitate a clear understanding of the invention, while omitting, for purposes of clarity, other elements that may also comprise a portion of the invention.

The invention claimed is:

1. A clamping tool for securing an underwater protective shield or cover, the clamping tool comprising a clamp, a jaw attachment and a plurality of locking bolts;

the clamp comprising a first claw, a second claw, and a pivot;

the jaw attachment comprising a first tube connected to the first claw and a second tube connected to the second claw;

wherein the first tube and the second tube comprise a plurality of holes for receiving the plurality of locking bolts;

the pivot being configured to transform a rotational torque applied by a user into a clamping pressure of the jaw attachment.

2. The clamping tool of claim 1, wherein the first tube and the second tube extend transversely with respect to the first claw and the second claw; a longitudinal length of each of the first tube and the second tube being sufficient such that the first tube and the second tube extend beyond each side of the first claw.

3. The clamping tool of claim 1, wherein the clamp is located at a mid-point of a longitudinal length of the jaw attachment.

4. The clamping tool of claim 1, wherein the first claw comprises two parallel plate members interconnected by a plurality of pins.

5. The clamping tool of claim 1, wherein the second claw comprises two parallel plate members interconnected by a plurality of pins.

6. The clamping tool of claim 1, wherein the first claw and second claw are connected together via a centrally positioned fixed pin.

7. The clamping tool claim 1, wherein the plurality of holes is aligned on the first tube and the second tube.

8. The clamping tool of claim 7, wherein the plurality of holes comprises a first plurality of holes aligned on the first tube and the second tube to one side of the clamp and a second plurality of holes aligned on the first tube and the second tube to an opposed side of the clamp; the first plurality of holes receiving a first locking bolt and the second plurality of holes receiving a second locking bolt.

9. The clamping tool of claim 1, wherein the pivot comprises a threaded rod and optionally a ratchet attachment.

10. he clamping tool of claim 1, wherein the first claw resembles an L-shape bracket, and optionally comprises a widened centre support.

11. The clamping tool of claim 1, wherein the jaw attachment is integrated into the clamp.

12. The clamping tool of claim 1, wherein the first tube is welded to the first claw and the second tube is welded to the second claw.

13. The clamping tool of claim 1, wherein the first tube is detachable from the first claw and the second tube is detachable from the second claw.

14. The clamping tool of claim 1, wherein the first tube and the second tube are square tubing.

15. The clamping tool of claim 1, comprising more than one clamp attached to the jaw attachment.

16. A clamping tool for securing a protective cover, the clamping tool comprising a clamp, a jaw attachment and a plurality of locking bolts;

the clamp comprising a first claw, a second claw, and a pivot having a threaded rod;

the jaw attachment comprising a first tube connected to the first claw and a second tube connected to the second claw;

the first tube and the second tube extending transversely to the clamp;

the clamp being attached to the first tube at a central point of a longitudinal length of the first tube and the clamp being attached to the second tube at a central point of a longitudinal length of the second tube;

the first tube extending beyond outer faces of the first claw;

the second tube extending beyond outer faces of the second claw;

the first tube and the second tube comprising a plurality of holes including at least a first plurality of holes aligned on the first tube and the second tube and located to one side of the clamp and a second plurality of holes aligned on the first tube and the second tube and located to another side of the clamp such that the clamp is located between the first plurality of holes and the second plurality of holes;

the first plurality of holes receiving a first locking bolt and the second plurality of holes receiving a second locking bolt;

wherein the pivot is configured to transform a rotational torque applied by a user into a clamping pressure of the jaw attachment.

17. A clamping system comprising:

a clamping tool, the clamping tool comprising a clamp, a jaw attachment and a plurality of locking bolts;

the clamp comprising a first claw, a second claw, and a pivot;

the jaw attachment comprising a first tube connected to the first claw and a second tube connected to the second claw;

wherein the first tube and the second tube comprise a plurality of holes for receiving the plurality of locking bolts;

the pivot being configured to transform a rotational torque applied by a user into a clamping pressure of the jaw attachment and a power tool, wherein the pivot of the clamping tool comprises a threaded rod and a ratchet attachment and the power tool comprises a socket for driving engagement with the ratchet attachment.

18. A method of securing a protective cover comprising the step of temporarily securing the protective cover using a clamping tool before a final assembly of the protective cover is completed;

wherein the protective cover comprises a lip having a plurality of holes;

wherein the clamping tool comprises a jaw attachment having a first tube connected to a first claw and a second tube connected to a second claw;

the first tube having a plurality of holes and the second tube having plurality of holes, the first claw and the second claw being movable by rotational torque applied to a threaded rod to induce a clamping pressure of the jaw attachment;

wherein temporarily securing the protective cover comprises aligning the plurality of holes of the lip of the protective cover with the plurality of holes of the first tube and the plurality of holes of the second tube;

subsequently inserting a plurality of locking bolts through the plurality of holes of the lip of the protective cover and the plurality of holes of the first tube and the plurality of holes of the second tube;

rotating the threaded rod to decrease the distance between the first tube and the second tube to apply a uniform clamping pressure onto the lip of the protective cover.

19. The method of claim 18, wherein after temporarily securing the protective cover using the clamping tool, the protective cover is finally assembled, wherein said final assembly comprises inserting and securing a plurality of screws or bolts through the lip of the protective cover and subsequently removing the clamping tool.

20. The method of claim 18, wherein temporarily securing the protective cover takes place underwater.

21. A clamping system comprising:

a clamping tool comprising a clamp, a jaw attachment and a plurality of locking bolts;

the clamp comprising a first claw, a second claw, and a pivot having a threaded rod;

the jaw attachment comprising a first tube connected to the first claw and a second tube connected to the second claw;

the first tube and the second tube extending transversely to the clamp;

the clamp being attached to the first tube at a central point of a longitudinal length of the first tube and the clamp being attached to the second tube at a central point of a longitudinal length of the second tube;

the first tube extending beyond outer faces of the first claw;

the second tube extending beyond outer faces of the second claw;

the first tube and the second tube comprising a plurality of holes including at least a first plurality of holes aligned on the first tube and the second tube and located to one side of the clamp and a second plurality of holes aligned on the first tube and the second tube and located to another side of the clamp such that the clamp is located between the first plurality of holes and the second plurality of holes;

the first plurality of holes receiving a first locking bolt and the second plurality of holes receiving a second locking bolt;

wherein the pivot is configured to transform a rotational torque applied by a user into a clamping pressure of the jaw attachment; and a power tool, wherein the pivot of the clamping tool comprises a threaded rod and a ratchet attachment and the power tool comprises a socket for driving engagement with the ratchet attachment.

* * * * *